US005811508A

United States Patent [19]

Zeitler et al.

[11] Patent Number: 5,811,508

[45] Date of Patent: Sep. 22, 1998

[54] HYDROLYSIS-RESISTANT POLYESTER FIBERS AND FILAMENTS, MASTERBATCHES AND PROCESSES FOR THE PRODUCTION OF POLYESTER FIBERS AND FILAMENTS

[75] Inventors: Herbert Zeitler, Grossaitingen; Reimund Brecheler, Schwabmünchen, both of Germany

[73] Assignee: Hoechst Trevira GmbH & Co KG, Germany

[21] Appl. No.: 767,403

[22] Filed: Dec. 16, 1996

[30] Foreign Application Priority Data

Dec. 15, 1995 [DE] Germany ..... 195 47 028.1

[51] Int. Cl.[6] ..... C08G 63/00

[52] U.S. Cl. ..... 528/176; 428/357; 428/364; 428/480; 524/195; 524/437

[58] Field of Search ..... 528/176; 428/480, 428/357, 364; 524/195, 437

[56] References Cited

U.S. PATENT DOCUMENTS 5,246,992 9/1993 Wick et al. ..... 524/195

FOREIGN PATENT DOCUMENTS 0 072 917 3/1983 European Pat. Off. .
0 417 717 3/1991 European Pat. Off. .
0 503 421 9/1992 European Pat. Off. .
0 506 983 10/1992 European Pat. Off. .
43 07 392 4/1994 Germany .
645 658 10/1984 Switzerland .
2 292 385 2/1996 United Kingdom .
WO 8301253 4/1983 WIPO .

OTHER PUBLICATIONS

Patent Abstracts of Japan, vol. 018, No. 107, Feb. 22, 1994 & JP 05 302212 (Toray Ind Inc), Nov. 16, 1993.
Database WPI Section Ch, Week 9531 Derwent Publications Ltd., London, GB; Class A23, An95–237442 & JP 07 145 511 A (Nippon Ester Co Ltd), Jun. 6, 1995.

*Primary Examiner*—Terressa Mosley
*Attorney, Agent, or Firm*—Connolly & Hutz

[57] ABSTRACT

A process for the production of hydrolysis resistant polyester fibers and filaments (preferably monofilaments for use in paper making machine sieves) comprises feeding a masterbatch of a polymeric carrier and an end group blocking agent to a spinneret together with a thread-forming polyester material, wherein the polymeric carrier has practically no end groups which react with the end group blocking agents. In addition to the process and the masterbatch, the polyester fibers or filaments of increased resistance to hydrolysis, in which the agents for blocking the end groups are distributed inhomogeneously over the cross-section of the monofilament, comprise a content of end group blocking agent that increases continuously from the core to the jacket of the fiber.

12 Claims, No Drawings

HYDROLYSIS-RESISTANT POLYESTER FIBERS AND FILAMENTS, MASTERBATCHES AND PROCESSES FOR THE PRODUCTION OF POLYESTER FIBERS AND FILAMENTS

DESCRIPTION

Hydrolysis-resistant polyester fibers and filaments, masterbatches and processes for the production of polyester fibers and filaments The invention relates to polyester fibers and filaments, preferably monofilaments of polyester, in which the end groups of the polyester have been stabilized against thermal and, in particular, hydrolytic degradation by addition of end group blocking agents, preferably by addition of mono-, bis- and polycarbodiimides, concentrates (masterbatches) comprising these end group blocking agents and inert polymeric carriers, and processes for the production of the fibers.

It is known that polyester molecules are split under exposure to heat. For example, in a polyethylene terephthalate, splitting of the ester bond takes place to form a carboxyl end group and a vinyl ester, the vinyl ester then reacting further, acetaldehyde being split off. Such thermal decomposition is influenced, above all, by the level of the reaction temperature, the residence time and possibly by the nature of the polycondensation catalyst.

In contrast, the resistance of a polyester to hydrolysis depends greatly on the number of end groups. It is known that an improvement in the resistance to hydrolysis can be achieved if the carboxyl end groups of polyesters are blocked by chemical reaction. Such blocking or "masking" of the carboxyl end groups has already been described in EP-A-0417717 and is carried out by reaction with aliphatic, aromatic or also cycloaliphatic mono-, bis- or polycarbodiimides.

It is known from the same publication that combination of mono- or biscarbodiimides with polycarbodiimides is advantageous for controlling the volatility of these products or cleavage products thereof and the associated pollution of the environment or nuisance to the operating personnel of papermaking machine sieves in which such fibers which have been rendered resistant are often employed. A process in which blocking of the carboxyl end groups is first predominantly carried out by reaction with mono- and/or biscarbodiimides and a polycarbodiimide is present in free form, which is helping to provide improved long-term stability of the fibers or filaments on the basis of its "depot action", has proven particularly suitable here.

Monofilaments with soil-repellent properties and with improved resistance to hydrolysis are known from EP-A-0 506 983 and DE 43 07 394. The monofilaments described comprise polyesters based on polyethylene terephthalate or poly-1,4-cyclohexanedimethylene terephthalate with additions of fluorine-containing polymers.

DE 43 07 392 also describes hydrolysis-resistant monofilaments of polyester. For blocking the carboxyl end groups of the polyester, carbodiimides are admixed as a concentrate (masterbatch) in the extruder. The carrier material for the carbodiimide concentrate comprises polyethylene terephthalate. In addition to carbodiimides, keteneimines are also employed as polyester stabilizer.

The monofilaments described which comprise fluorine-containing polymers have soil-repellent properties. This property is attributed to the effect of migration, where the fluorine component migrates to the surface of the monofilament.

A disadvantage of the processes known to date is that, in order to achieve an adequate resistance of the fibers to hydrolysis, a relatively large amount of stabilizing additives must still be added for blocking of the end groups, compared with the fibers according to the invention. In order to reduce the pollution of the environment or the nuisance to the operating personnel still further, there was thus still the object of reducing the content of these stabilizers in the fibers without having to accept a decrease in stability to hydrolysis.

Surprisingly, this object is achieved by a process in which the material usually used as a carrier in the concentrate for the end group blocking agent (masterbatch) is replaced by a material which is inert with respect to the end group blocking agent.

According to the invention, all materials which are suitable as carriers for the end group blocking agent and which themselves contain no carboxyl or hydroxyl end groups and thus do not react with the end group blocking agent before the end group blocking agent has reached the fiber are described as inert in respect of the end group blocking agent.

Preferred carrier materials are those which, in contrast to the carrier materials usually used, such as polyethylene terephthalate, contain particularly few and in particular practically no reactive end groups, so that the actual action of the agent for blocking end groups cannot take place in the previously prepared masterbatch but can only take place after the addition during production of the fibers.

Suitable carrier materials are polymers or copolymers based on ethylene, propylene and higher α-olefins or halogenated ethylenically unsaturated hydrocarbons.

Carrier materials which are preferably employed are polymers or copolymers based on ethylenically unsaturated fluorinated hydrocarbons, in particular copolymers based on tetrafluoroethylene, ethylene and, where appropriate, at least one α-olefin which can be copolymerized with these, as long as they have a melting point which allows softening or liquefaction of the copolymers in the production equipment used for the polyester fibers. Fluorinated copolymers which preferably have a crystallite melting point in the range from 160° to 270° C. are particularly preferred. Examples of suitable tetrafluoroethylene copolymers are described in detail in DE-A 41 31 756.

Another preferred fluorinated hydrocarbon compound which can be employed as the carrier is fluorinated polyvinylidene (PVDF), which is available under the trade name ®Kynar from Elf Atochem.

A polytetrafluoroethylene copolymer (trade name ®HOSTAFLON ET 6060 from Hoechst AG) is especially preferably employed as the carrier material in the masterbatch.

Polymers and copolymers based on tetrafluoroethylene are distinguished by a number of advantages, for example by good UV transparency and therefore good resistance to UV, by good resistance to weathering, good dielectric properties and by a high resistance to chemicals, in particular by good resistance to hydrolysis. The highly hydrophobic surface of moldings of these polymers and copolymers leads to correspondingly low adhesion properties, which manifest themselves, for example, in a pronounced soil-repellency.

Suitable agents for blocking the end groups in the polyester are, for example, mono-, bis- or polycarbodiimides, and glycidyl ethers, such as N-glycidyl-phthalimide (trade name ®DENACOL EX 731 from Nagase). The end group blocking agents can preferably also be employed in mixtures.

A process in which mono- and/or biscarbodiimides are initially added directly, that is to say without a masterbatch, and polycarbodiimides are additionally added as a masterbatch is particularly preferred.

To produce high-performance fibers, it is necessary to employ polyesters which have a high average molecular weight, corresponding to an intrinsic viscosity (limiting viscosity) of at least 0.64 [dl/g]. The measurements were carried out in dichloroacetic acid at 25° C.

It is furthermore advantageous to employ polyesters which already contain only a small amount of carboxyl end groups, on the basis of their preparation, as spinning material. This can be effected, for example, by use of the so-called solids condensation process. It has been found that polyesters to be employed should contain less than 20, preferably even less than 10 meq of carboxyl end groups per kg. The increase due to melting, preferably in the extruder, has already been taken into account in these values.

In principle, all thread-forming polyesters, i.e. aliphatic/aromatic polyesters, such as, for example, polyethylene terephthalates or polybutylene terephthalates, or else completely aromatic and, for example, halogenated polyesters can be employed in the same manner for the use according to the present invention. Units of thread-forming polyesters are preferably diols and dicarboxylic acids, or correspondingly built-up hydroxycarboxylic acids.

The preferred acid constituent of the polyesters employed according to the invention is terephthalic acid. Other aromatic compounds, which preferably have the para or trans configuration, such as, for example, 2,6-naphthalenedicarboxylic acid, and also p-hydroxybenzoic acid, are of course also suitable.

Typical suitable dihydric alcohols are, for example, ethylene glycol, propanediol, 1,4-butanediol and also hydroquinone. Preferred aliphatic diols have two to four carbon atoms. Ethylene glycol is particularly preferred. However, longer-chain diols can be employed in proportions of up to about 20 mol %, preferably less than 10 mol %, for modification of the properties.

For particular industrial tasks, however, high molecular weight polymers of pure polyethylene terephthalate and copolymers thereof with small additions of comonomers have proven particularly appropriate, as long as the exposure to temperature matches the properties of polyethylene terephthalate in the first place. Otherwise, suitable known completely aromatic polyesters should be used.

Polyester fibers and filaments according to the invention which predominantly or completely comprise polyethylene terephthalate, and in particular those which have a molecular weight corresponding to an intrinsic viscosity (limiting viscosity) of at least 0.64, preferably at least 0.70 [dl/g], are accordingly particularly preferred. The intrinsic viscosities are determined in dichloroacetic acid at 25° C.

In a preferred embodiment, the carboxyl end groups are blocked by reacting the carboxyl end groups predominantly with mono- and/or biscarbodiimides, the fibers and filaments comprising only very low or no amounts of these carbodiimides in the free form. The polyester fibers and filaments here preferably still comprise 0.05% by weight of at least one polycarbodiimide, where this polycarbodiimide should be present in the free form or with at least still a few reactive carbodiimide groups. Preferably, the fibers or filaments should comprise less than 3 meq/kg of carboxyl end groups. Fibers and filaments in which the number of carboxyl end groups has been reduced to less than 2, in particular even less than 1.5 meq/kg of polyester are particularly preferred. The content of free mono- and/or biscarbodiimides in the fiber or in the filament should preferably be less than 500 ppm, in particular less than 200 ppm (by weight) of polyester. In order to keep the pollution of the environment particularly low, a content of these end group blocking agents of less than 50, in particular less than 20, especially preferably even less than 10 ppm (by weight) of polyester is preferably favorable.

In this preferred embodiment, it should be ensured that the fibers and filaments still comprise polycarbodiimides or reaction products thereof with groups which are still reactive. Concentrations of 0.02 to 2, in particular 0.1 to 0.6% by weight of polycarbodiimide in the polyester fibers and filaments are preferred. A polycarbodiimide content of 0.3 to 0.5% by weight is especially preferred. The percent by weight data are based on the total weight. The molecular weight of suitable carbodiimides is between 2000 and 15,000, preferably between 5000 and about 10,000. In the preferred embodiment, these polycarbodiimides assume, above all, a depot function.

The stoichiometric amount of end group blocking agents added is to be understood as the amount, in milliequivalents per weight unit of the polyester, which can and should react with the terminal end groups of the polyester. When calculating the stoichiometrically required amount, it should be taken into consideration that additional end groups are usually formed during exposure to heat, such as, for example, during melting of the polyester.

The use of monocarbodiimides which are preferably added as such, that is to say not as a masterbatch, is particularly preferred. These compounds are distinguished in particular by a high rate of reaction during the reaction with the polyester. In another preferred embodiment, these are partly or completely replaced by corresponding amounts of biscarbodiimides, in order to utilize the lower volatility which is already noticeable in these compounds. In this case, however, it should be ensured that the contact time chosen is sufficiently long in order also to guarantee an adequate reaction during mixing and melting in the melt extruder when biscarbodiimides are employed.

Polyesters and many customary end group blocking agents, such as, for example, carbodiimides, cannot be stored for any desired length of time at high temperatures. It has already been pointed out above that additional carboxyl end groups are formed during melting of polyesters. Many of the end group blocking agents employed can also decompose at the high temperatures of the polyester melts. It is therefore desirable to limit the contact and reaction time of the end group blocking agents with the molten polyesters as much as possible. If melt extruders are employed, it is possible to reduce this residence time in the molten state to less than 5 minutes, preferably less than 3 minutes. Limitation of the melting time in the extruder is determined only by the fact that adequate thorough mixing of the reactants must take place for complete reaction between the end group blocking agent and carboxyl end groups or also hydroxyl end groups. This can be effected by an appropriate design of the extruder or, for example, by the use of static mixers.

According to the preferred embodiment, the end groups, preferably carboxyl end groups, which still remain in the polyesters after the polycondensation are predominantly carboxyl end groups and should be blocked by reaction preferably with a mono- or biscarbodiimide. Preferably, a lower proportion of the carboxyl end groups will also react under these conditions with carbodiimide groups of the polycarbodiimide additionally added as a masterbatch.

In this case, the polyester fibers and filaments therefore comprise, instead of the carboxyl end groups, essentially reaction products thereof with the carbodiimides employed. Mono- or biscarbodiimides, which should occur in the fibers and filaments in the free form to only a small extent, if at all, are the known aryl-, alkyl- and cycloalkyl-carbodiimides. In the diarylcarbodiimides, which are preferably employed, the aryl nuclei can be unsubstituted. Preferably, however, aromatic carbodiimides which are substituted in the 2- or 2,6-position and are therefore sterically hindered are employed. DE-B 1 494 009 already lists a large number of monocarbodiimdes with steric hindrance of the carbodiimide group. Of the monocarbodiimides, for example, N,N'-(di-o-tolyl)carbodiimide and N,N'-(2,6,2',6'-tetraisopropyl) diphenylcarbodiimide are particularly suitable. Biscarbodiimides which are suitable according to the invention are described, for example, in DE-A 20 20 330.

Suitable polycarbodiimides are compounds in which the carbodiimide units are bonded to one another via mono- or disubstituted aryl nuclei, possible aryl nuclei being phenylene, naphthylene, diphenylene and the divalent radicals derived from diphenyl methane, and the substituents corresponding in nature and substitution site to the substituents of the mono-diarylcarbodiimides substituted in the aryl nucleus.

The end group blocking agent added with the masterbatch in concentrated form is preferably a polycarbodiimide having an average molecular weight of 2000 to 15,000, but in particular 5000 to 10,000. These polycarbodiimides react with the carboxyl end groups at a significantly slower rate and are therefore present either in bonded form or in the free form. If such a reaction occurs, preferably only one group of the carbodiimide will initially react. However, the other groups present in the polymeric carbodiimide lead to the desired depot action and are the reason for the considerably improved stability of the resulting fibers and filaments. For this desired resistance of the shaped polyester compositions to heat and, in particular, hydrolysis, it is therefore particularly preferable that the polymeric carbodiimides present in them have not yet reacted completely, but still contain free carbodiimide groups to trap further carboxyl end groups.

A particularly preferred polycarbodiimide is the commercially available aromatic polycarbodiimide which is substituted with isopropyl groups in the o-position relative to the carbodiimide groups, i.e. in the 2,6- or 2,4,6-position on the benzene nucleus. Such a polycarbodiimide is marketed by Rhein-Chemie, Rheinhausen under the trade name ®Stabaxol P100. However, this polycarbodiimide is available only as a masterbatch with a polymeric non-inert carrier, such as, for example, polyethylene terephthalate.

The polyester fibers and filaments according to the invention which have been produced can comprise the customary additives, such as, for example, titanium dioxide as a matting agent, or additives, for example, for improving colorability or for reducing electrostatic charging. In the same manner, additives or comonomers which can reduce, in a known manner, the combustibility of the fibers and filaments produced are of course also suitable.

It is also possible, for example, for colored pigments, carbon black or soluble dyes to be incorporated into or already present in the polyester melt. By admixing other polymers, such as, for example, polyolefins, polyesters or polyamides, it is possible, where appropriate, to achieve desired textiles-related effects. The addition of substances which have a crosslinking action and are known per se and similar additives can also bring advantages for selected fields of use.

As already mentioned above, mixing and melting is necessary for production of the polyester fibers and filaments according to the invention. This melting can preferably be carried out in a melt extruder directly before the actual spinning operation. The end group blocking agents are added either via prior preparation of stock batches, so-called masterbatches, or at least partly directly by admixing in the liquid or solid form. With masterbatches as concentrates, the polyester material to be treated can be mixed with the end group blocking agent directly before the extruder or, for example if a twin-screw extruder is used, in the extruder.

If prestabilized polyester is used according to the preferred embodiment, a suitable end group blocking agent, preferably a mono- and/or biscarbodiimide, is first added to the polyester without a masterbatch, in particular in liquid form. The amount of the additive usually depends on the end group content of the starting polyester, preferably on the carboxyl end group content, taking into account the additional end groups of the polyester which are probably also formed during the melting operation. To achieve the lowest possible pollution of the environment and nuisance to the operating personnel, it is also possible preferably to use less than the stoichiometric amounts of mono- and biscarbodiimides. In particular, the amount of mono- and biscarbodiimides added should be less than 90% of the stoichiometrically calculated amount, and 50 to 85% of the stoichiometric amount of mono- and biscarbodiimide corresponding to the carboxyl end group content is particularly preferably added. It should be ensured here that losses do not occur due to premature evaporation of the mono- and bisdicarbodiimides employed.

According to the invention, at least one end group blocking agent is added as a concentrate in the form of stock batches (masterbatch) of a carrier material and a higher percentage, for example, 15%, of polycarbodiimide. These end group blocking agents added as a masterbatch are preferably polycarbodiimides.

In the fibers and filaments produced, the end group blocking agents are present in still unreacted form or as a reaction product with the reactive groups. Concentrations of 0.02 to 2, in particular 0.1 to 0.6% by weight of end group blocking agent in the polyester fibers and filaments are preferred. A content of 0.3 to 0.5% by weight is especially preferred.

Because of side reactions which occur during exposure of the polyester and the end group blocking agent employed to heat, owing to the joint melting operation, the residence time of the end group blocking agent in the melt should preferably be less than 5 minutes, in particular less than 3 minutes.

The resistance to hydrolysis is determined by a method analogous to that described in EP-A-0 486 916 via the decrease in the strength of the filament after treatment in an environment which damages the filament. The monofilament to be tested is exposed to an atmosphere of steam at a temperature of 135° C. for 80 hours. The monofilament is then dried and the tear strength is determined by customary methods. Comparison of the tear strength with the untreated monofilament is a measure of the resistance to hydrolysis. The percentage residual tear strength of the fibers according to the invention is preferably above 50%, in particular above 75%. A tear strength of more than 80% is particularly preferred. Values above 90% are especially preferred.

Inhomogeneous distribution of the blocking agent introduced over the cross-section of the monofilament can be detected, for example, by removing the outer layer of the monofilament and determining the content of blocking agent in the core which remains, and by subsequently comparing this value with the content of blocking agent in the original fiber.

It is found that, especially in the case where carriers which lead to the known migration effect in the fiber are employed, the carriers in the fibers produced according to the invention cause a type of core/jacket structure over the cross-section of the fiber in respect of the end group blocking agent. The agent for blocking end groups becomes concentrated in the region of the jacket of the fiber as a result, so that the content of end group blocking agent added as a masterbatch increases continuously toward the jacket of the fiber.

Polyester fibers, preferably monofilaments, which have a lower total amount of blocking agent within the monofilament, because of the inhomogeneous distribution, compared with conventional homogeneous fibers with the same concentration of end group blocking agent on the surface can accordingly be prepared with the masterbatches according to the invention.

The fibers thus produced, in which the end group blocking agent has been added with a carrier with hydrophobic properties, are distinguished by a particularly good soil-repellent action.

As a stability test, the tenacity (=tear strength) was tested on the resulting monofilaments once directly after production and a second time after storage of the monofilaments at 135° C. in a steam atmosphere for 80 hours, and the quotient of the residual tear strength and original tear strength was calculated. This is a measure of the stabilizing action achieved by the additives and is stated in %, based on the value before storage.

Fibers which have a residual tear strength of more than 50%, in particular more than 70%, after treatment in steam are preferably provided by the invention. Monofilaments having residual tear strengths greater than 80%, in particular greater than 90%, are particularly preferred.

The nitrogen content of the fibers according to the invention of course depends on the amount of end group blocking agent added, if the end group blocking agent contains nitrogen. If nitrogen-containing end group blocking agents, such as, for example, carbodiimides, are used exclusively, the nitrogen content can be used as a measure of the content of end group blocking agents. Such fibers according to the invention preferably comprise less than 0.5% by weight of nitrogen, in particular less than 0.2% by weight, particularly preferably less than 0. 12% by weight of nitrogen, based on the total weight.

The polyester fibers, preferably polyester filaments, according to the invention are particularly suitable for use under aggressive conditions, such as prevail in a papermaking machine. The pollution of the environment and in particular the nuisance to the operating personnel is lower here than with known polyester fibers or filaments of comparable structure because of the reduced content of end group blocking agents.

Polyester filaments having a circular or profiled cross-section which have a diameter—where appropriate an equivalent diameter—of preferably 0.1 to 2.0 mm are preferred.

These filaments are preferably employed for the production of papermaking machine sieves.

EXAMPLES

The following examples serve to illustrate the invention without limiting it. Dried polyester granules which had been subjected to solids condensation and had an average carboxyl end group content of 5 meq/kg of polymer were employed in all the examples. A monomeric carbodiimide with the designation N,N'-2,2',6,6'-tetraisopropyldiphenylcarbodiimide was used as the low molecular weight end group blocking agent. The high molecular weight end group blocking agent employed in the experiments described below was an aromatic polycarbodiimide, which contained benzene nuclei in each case substituted in the o-position, i.e. in the 2,6- or 2,4,6-position, with isopropyl groups. The agent was employed not in the pure state but as a masterbatch.

In Examples 1–8, the masterbatch was a mixture of 15% by weight of polycarbodiimide (commercial product ®Stabaxol P100 from Rhein-Chemie, Rheinhausen, Germany) and 85% by weight of a PTFE copolymer with ethylene as a comonomer (commercial product ®HOSTAFLON ET 6060 from Hoechst AG, Frankfurt).

The low molecular weight carbodiimide in liquid form was mixed with the masterbatch and the polymer material in containers by mechanical shaking and stirring. This mixture was then introduced into a single-screw extruder from Reifenhauser, Germany, Type S 45 A. The individual extruder zones had temperatures of 282° to 293° C. and the extruder was operated at a discharge of 580 g of melt/minute using customary spinnerets for monofilaments. The residence time of the mixtures in the molten state was 2.5 minutes. The freshly spun monofilaments were quenched, after a short air zone, in a water-bath and then stretched continuously in two stages. The stretching ratio in all the experiments was 1:4.3.

The temperatures during stretching were 80° C. in the first stage and 90° C. in the second stage, and the running speed of the spun threads after leaving the quenching bath was 32 m/minute. Thereafter, heat setting was carried out in a setting channel at a temperature of 275° C. All the spun monofilaments have a final diameter of 0.5 mm.

Example 1

In this example, monofilaments were spun without any addition. The resulting specimens comprised no nitrogen, since no carbodiimides were present. The carboxyl end group content was 6.4 meq/kg of polymer. The experimental conditions and the results obtained have been summarized in the following table.

Examples 2, 4 and 5

A monofilament was again produced under the same conditions as in Example 1, 0.25 or 0.45% by weight of N,N"-(2,6,2',6'-tetraisopropyldiphenyl)carbodiimide being employed as a blocking agent for the carboxyl groups. The amount of 0.45% by weight in Example 2 corresponded to a value of 0.029% by weight of nitrogen, based on the total weight.

In addition, the PTFE copolymer ®HOSTAFLON ET, that is to say without polycarbodiimide, was also added in varying amounts.

Examples 3, 6 and 7

A monofilament wherein, according to the invention, in addition to monocarbodiimide, a polycarbodiimide was also employed, this being added as a masterbatch with ®HOSTAFLON ET as a carrier, was produced in these examples.

Example 8

This example was also carried out according to the invention. For production of this monofilament, exclusively polycarbodiimide was added as a masterbatch. The polymeric carrier again comprised ®HOSTAFLON ET.

Examples 9a and 9b

For comparison, a masterbatch based on 85% by weight of polyethyleneterephthalate and 15% by weight of polycarbodiimide (commercial product ®Stabaxol KE 7646 from Rhein-Chemie, Rheinhausen, Germany) was used.

The monofilaments in Examples 9a and 9b were produced with a higher content of masterbatch. Example 9a shows that a residual tear strength after hydrolysis of about 83%, corresponding to Example 7a, can be achieved only if a considerably larger amount of polycarbodiimide than in Example 7a is added.

The results of the experiment and the reaction conditions are summarized in the following table. The monocarbodiimide added, expressed as percentage by weight added, and then, in a second column, the addition of the PTFE copolymer without polycarbodiimide, in % by weight, and in a third column the addition of the masterbatch in % by weight, are listed. The percentage by weight data are based on the total weight. In a fourth column, the nitrogen content of the specimens after production is stated, as a measure of the carbodiimide content. The strength values of the fibers before and after storage in hot steam are stated in the last 4 columns, the strength of the untreated filament being stated in newtons [N] and the strength of the treated filament via the residual tear strength in %.

The last two columns show the tear strength values and the residual tear strengths of monofilaments which have been set at 200° C. for 10 minutes beforehand (in the case of the fibers treated with steam, setting was carried out before the treatment with steam).

| Example | Mono-/bis-carbodiimide [% by weight] | PTFE-copolymer [% by weight] | Masterbatch of PTFE copolymer and polycarbodiimide [% by weight] | Nitrogen content before hydrolysis [% by weight] | Tear strength [N] | Residual tear strength after hydrolysis [%] | Tear strength after setting [N] | Residual tear strength after hydrolysis and after setting [%] |
|---|---|---|---|---|---|---|---|---|
| 1 | 0 | 0 | 0 | 0 | 110 | 31 | | |
| 2 | 0.45 | 0.75 | 0 | 0.029 | 109 | 65 | 55 | 51 |
| 3 | 0.45 | 0 | 0.75 | 0.043 | 111 | 75 | 72 | 65 |
| 4 | 0.25 | 2.5 | 0 | 0.015 | 108 | 52 | 42 | 39 |
| 5 | 0.45 | 2.5 | 0 | 0.029 | 107 | 64 | 63 | 59 |
| 6 | 0.25 | 0 | 2.5 | 0.053 | 107 | 72 | 70 | 65 |
| 7a | 0.45 | 0 | 2.5 | 0.068 | 107 | 83 | 84 | 79 |
| 7b | 0.45 | 0 | 4.8 | 0.107 | 101 | 89 | 101 | 83 |
| 8 | 0 | 0 | 2.5 | 0.037 | 109 | 48 | 43 | 40 |
| 9a | 0.45 | 0 | 6 (Carrier: PET) | 0.118 | 109 | 83 | 82 | 80 |
| 9b | 0.45 | 0 | 11 (Carrier: PET) | 0.217 | 109 | 85 | 85 | 81 |

We claim:

1. A process for the production of hydrolysis-resistant polyester fibers and filaments which comprises feeding a masterbatch comprising a polymeric carrier and an end group blocking agent to a spinneret together with a thread-forming polyester material, wherein the polymeric carrier has substantially no end groups which react with the end group blocking agents and the polymeric carrier is a fluorine-free copolymer of tetrafluoroethylene and ethylene, and wherein the end group blocking agent is polycarbodiimide.

2. A masterbatch for the production of polyester fibers and filaments with increased resistance to hydrolysis, comprising a polymeric carrier and an agent for blocking end groups, wherein the polymeric carrier contains substantially no end groups which react with the end group blocking agent under production conditions of the polyester fibers and filaments, and wherein the polymeric carrier is a fluorine-free copolymer of tetrafluoroethylene and ethylene, and the end group blocking agent is polycarbodiimide.

3. A masterbatch as claimed in claim 2, wherein the content of end group blocking agent in the masterbatch is 5–30% by weight.

4. Polyester fibers or filaments of increased resistance to hydrolysis comprising an agent for blocking end groups, which comprise a a fluorine-free copolymer based on tetrafluoroethylene and ethylene and, where appropriate, another α-olefin copolymerized with these, and wherein the agent for blocking end groups is distributed inhomogeneously over the cross-section of the monofilament.

5. Polyester fibers or filaments as claimed in claim 4, wherein the polyester has an average molecular weight corresponding to an intrinsic viscosity of at least 0.64 (dl/g), measured in dichloroacetic acid at 25° C.

6. Polyester fibers or filaments as claimed in claim 4, wherein a predominant portion of the end groups are blocked by a mono- or biscarbodiimide, and a polycarbodiimide is additionally also present.

7. Polyester fibers or filaments as claimed in claim 4, wherein the agent therein contains nitrogen for blocking the end groups, and wherein the resistance to hydrolysis, expressed by the percentage residual tear strength, is greater than 50%, and the content of nitrogen-containing end group blocking agent is less than 0.5% by weight.

8. Polyester fibers or filaments as claimed in claim 7, wherein the resistance to hydrolysis, expressed by the percentage residual tear strength, is greater than 80%.

9. Polyester fibers or filaments as claimed in claim 7, wherein the content of nitrogen-containing end group blocking agent is less than 0.2% by weight.

10. Polyester fibers or filaments as claimed in claim 4 which are monofilaments having a circular or profiled cross-section which have a diameter of 0.1 to 2.0 mm.

11. A masterbatch as claimed in claim 2 for use in the production of fibers or filaments of polyester.

12. Polyester fibers or filaments as claimed in claim 4, wherein the inhomogeneity comprises a content of end group blocking agent which increases continuously from the core to the jacket of the fiber.

* * * * *

UNITED STATES PATENT AND TRADEMARK OFFICE

CERTIFICATE OF CORRECTION

PATENT NO. : 5,811,508
DATED : September 22, 1998
INVENTOR(S) : Zeitler et al.

It is certified that error appears in the above-identified patent and that said Letters Patent is hereby corrected as shown below:

Column 10, line 1 (Claim 1, line 8), "fluorine-free" should read -- chlorine-free --.

Column 10, line 10 (Claim 2, line 7), "fluorine-free" should read -- chlorine-free --.

Column 10, line 18 (Claim 4, line 3), "fluorine-free" should read -- chlorine-free --.

Signed and Sealed this

Sixth Day of April, 1999

*Attest:*

Q. TODD DICKINSON

*Attesting Officer*

*Acting Commissioner of Patents and Trademarks*